US005297576A

United States Patent [19]

Weinheimer

[11] Patent Number: 5,297,576

[45] Date of Patent: Mar. 29, 1994

[54] ORAL INFLATION AND RELIEF TUBE

[75] Inventor: Jacek M. Weinheimer, Treasure Island, Fla.

[73] Assignee: Halkey-Roberts Corporation, St. Petersburg, Fla.

[21] Appl. No.: 962,386

[22] Filed: Oct. 16, 1992

[51] Int. Cl.[5] ..... F16K 15/20; B63C 9/00

[52] U.S. Cl. ..... 137/226; 137/512

[58] Field of Search ..... 137/223, 226, 454.2, 137/512

[56] References Cited

U.S. PATENT DOCUMENTS

| | | | |
|---|---|---|---|
| 1,255,354 | 2/1918 | Tischer | 137/223 |
| 1,355,230 | 10/1920 | Kaiser | 137/512 X |
| 2,264,321 | 12/1941 | Manson | 244/1 |
| 2,403,436 | 7/1946 | Heigis | 137/226 |
| 3,028,873 | 4/1962 | Kindred | 137/512 |
| 3,312,213 | 4/1967 | Timm | 137/226 X |
| 3,351,081 | 11/1967 | Bogossian et al. | 137/223 |
| 3,754,291 | 8/1973 | Harris et al. | 9/14 |
| 3,809,288 | 4/1974 | Mackal | 222/5 |
| 3,812,878 | 5/1974 | Bird et al. | 137/512 |
| 3,997,079 | 12/1976 | Niemann | 222/5 |
| 4,111,228 | 9/1978 | Simionescu | 137/512 |
| 4,176,681 | 12/1979 | Mackal | 137/516.29 |
| 4,223,805 | 9/1980 | Mackal | 222/5 |
| 4,260,075 | 4/1981 | Mackal | 222/5 |
| 4,267,944 | 5/1981 | Mackal | 222/5 |
| 4,305,425 | 12/1981 | Mackal | 137/541 |
| 4,498,879 | 2/1985 | Burr | 441/80 |
| 4,560,356 | 12/1985 | Burr | 441/80 |
| 4,627,823 | 12/1986 | Mackal | 441/95 |
| 4,955,407 | 9/1990 | Inoue | 137/454.2 |
| 5,135,025 | 8/1992 | Mackal | 137/541 |

*Primary Examiner*—John Rivell

*Attorney, Agent, or Firm*—Dominik, Stein, Saccocio, Reese, Colitz & Van Der Wall

[57] ABSTRACT

An oral inflation and relief tube for connection to an inflatable article. The oral inflation and relief tube includes an elongated tube having an oppositely positioned first opened end and second opened end, with a flanged opening positioned therebetween at ninety degrees for connection to the inflatable article. The flanged opening comprises a mounting flange and boss integrally formed through a wall of the elongated tube. The oral inflation and relief tube also includes an inflation valve sealingly positioned within the first opened end as well as a relief valve sealingly positioned within the second opened end. The elongated tube comprises an in-line configuration. The inflation valve and the relief valve and the tube comprise a generally-cylindrical configuration with a common axis, with the boss positioned substantially adjacent to the second opened end away from the first opened end such that when the mounting flange of the flanged opening is connected to the inflatable article, the in-line configuration of the elongated tube lies substantially parallel to the inflatable article. This permits the first opened end to be grasped and rotated about the boss and orally inflated. The inflation valve and the relief valve each have a coil spring with the coil spring of the relief valve having a high cracking pressure than the inflation valve.

1 Claim, 4 Drawing Sheets

ORAL INFLATION AND RELIEF TUBE

BACKGROUND OF THE INVENTION

1. Field of the Invention

This invention relates to oral inflation tubes for inflating inflatable articles such as personal flotation devices, rafts, buoys and emergency signalling equipment. Additionally, this invention relates to relief valves used in connection with such inflatable articles.

1. Description of the Background Art

Presently, there exists many types of inflatable articles such as personal flotation devices (life vests, rings and horseshoes), life rafts, and emergency signalling equipment. Typically, such inflatable articles include an inflator, to which is connected a compressed gas cartridge, for inflating the article either manually or automatically, a relief valve to vent air from the article in the event of over inflation, and an oral inflation tube to permit oral inflation. U.S. Pat. No. 3,809,288 discloses a manual inflator and U.S. Pat. Nos. 3,997,079, 4,223,805, 4,267,944, 4,260,075 and 4,627,823 disclose automatic inflators which automatically inflate the inflatable article upon being immersed in water, such as sea water. Automatic inflators are particularly desirable when the inflatable article is intended to be utilized during an emergency situation to inflate the inflatable article without a person's assistance or intervention. Illustrative examples of emergency signalling and rescue articles of this nature are disclosed in U.S. Pat. Nos. 2,264,321, 3,754,291, 4,498,879, 4,560,356 and 4,627,823.

Inflatable articles often include a relief valve connected through the wall of the inflatable bladder of the article The relief valve of this type typically comprises a spring-loaded valve seat which opens when the pressure inside the inflatable bladder exceeds a preset limit, thereby venting the inflatable bladder. Relief valves are most common for inflatable articles employing inflators, both automatic and manual, to prevent rupturing of the inflatable bladder upon inflation. Indeed, the volume of air contained within the gas cartridge may exceed the maximum volume of the inflatable bladder. In such instances, relief valves are essential.

Unfortunately, most relief valves include a specially-configured design which allows them to be molded through the wall of the inflation bladder. These specially-configured relief valves are more costly to manufacture than other types of available relief valves Even when inflators are employed, most inflation articles include an inflation valve to permit oral inflation of the article in the event of inflator malfunction. Oral inflation valves are also needed to permit oral inflation and deflation of the inflatable article when the article needs to be slightly inflated or deflated, such as when the day cools off in the evening or warms up in the morning causing a decrease or increase, respectively, of the volume of air in the bladder.

Oral inflation tubes are commonly used in connection with inflatable articles. Conventional oral inflation tubes typically comprise a tubular configuration having one end integrally formed in a flange to be sealingly connected through the wall of the inflation bladder. An inflation valve is positioned in the other end of the tube. The inflation tube is designed to make it easier for the inflatable article to be inflated by a person. For example, a life vest typically includes an inflation tube which extends from a middle or lower portion of the life vest upwardly toward the face of the person wearing the life vest. In this arrangement, upon the simple bending of the person's neck, the end of the tube may be easily mouthed to inflate the bladder. The person therefore need not remove the life vest simply to inflate the same.

In addition to facilitating easy inflation, oral inflation tubes allow conventional inflation valves to be utilized. Specifically, because the inflation tube comprises a circular cylindrical configuration, many of the large variety of cylindrically-shaped inflator valves may be utilized by simply pressing the inflator valve into the end of the tube. The use of such conventional inflation valves results in a substantial cost savings over other types of valves, such as relief valves, that are specially designed to be sealed through the wall of the inflation bladder.

As should be appreciated, a relief valve and an oral inflation tube with its inflation valve, are two separate components, both of which must be sealingly installed through the wall of the bladder. As separate components, the cost of assembly is double and the risk of a leak during assembly or later during use, is doubled Hence, there presently exists a need for a way to combine the functions of both the relief valve and the inflation tube with its inflation valve so as to minimize the cost of assembly and to minimize the chance of a leak, thereby maximizing reliability and safety.

It is an object of this invention to provide an improvement which overcomes the aforementioned inadequacies of the prior art devices and provides an improvement which is a significant contribution to the advancement of the oral inflation tube art.

SUMMARY OF THE INVENTION

For the purpose of summarizing this invention, this invention comprises an oral inflation and relief tube having both an inflation valve and a relief valve installed therein to permit oral inflation and automatic venting of the inflatable article to which it is attached More specifically, the oral inflation and relief tube of this invention comprises a generally tubular configuration having a first and second opened end. Between the opened ends, a mounting flange is integrally formed through the wall of the tube. The flange is conventionally configured to permit it to be sealed through the wall of a bladder of the inflation article. An oral inflation and relief tube of this configuration permits a conventional inflation valve and a conventional relief valve to be utilized. Furthermore, because there is only one opening made through the bladder during sealing of the flange thereto, the assembly costs are minimized and the risk of a leak developing during assembly or later, is also minimized. Hence, a significant improvement in the art is achieved.

The foregoing has outlined rather broadly the more pertinent and important features of the present invention in order that the detailed description of the invention that follows may be better understood so that the present contribution to the art can be more fully appreciated Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENTS

Figure 1:
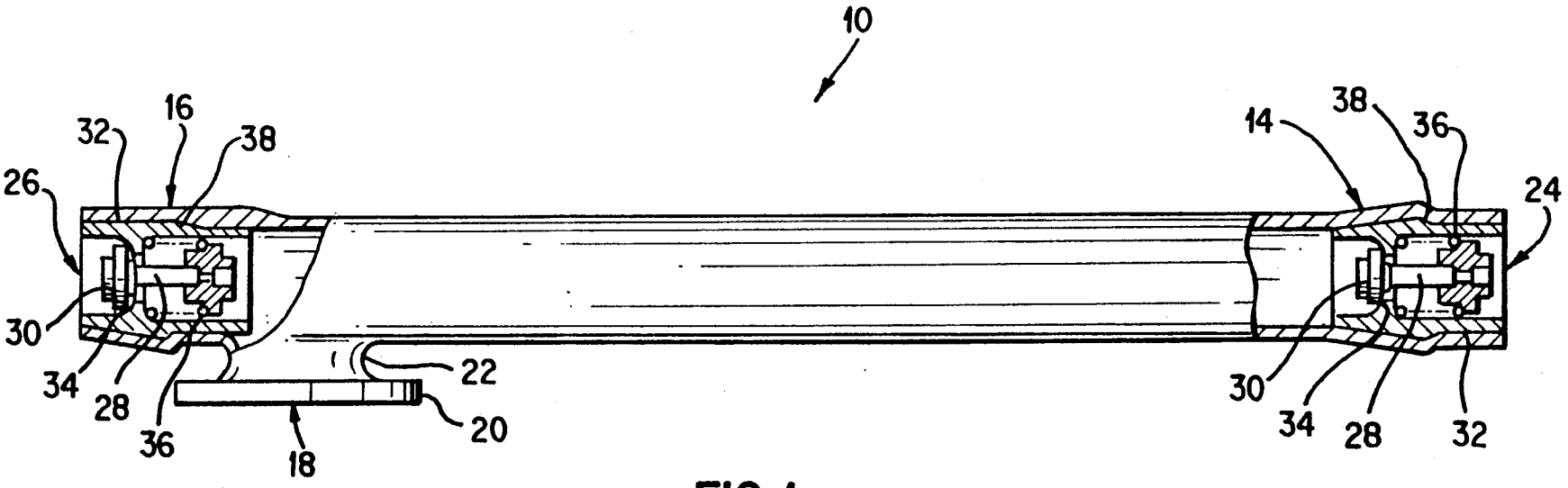
FIG. 1 is a side view, partially in section, of the in-line configuration of the oral inflation and relief tube of the invention.
Figure 2:
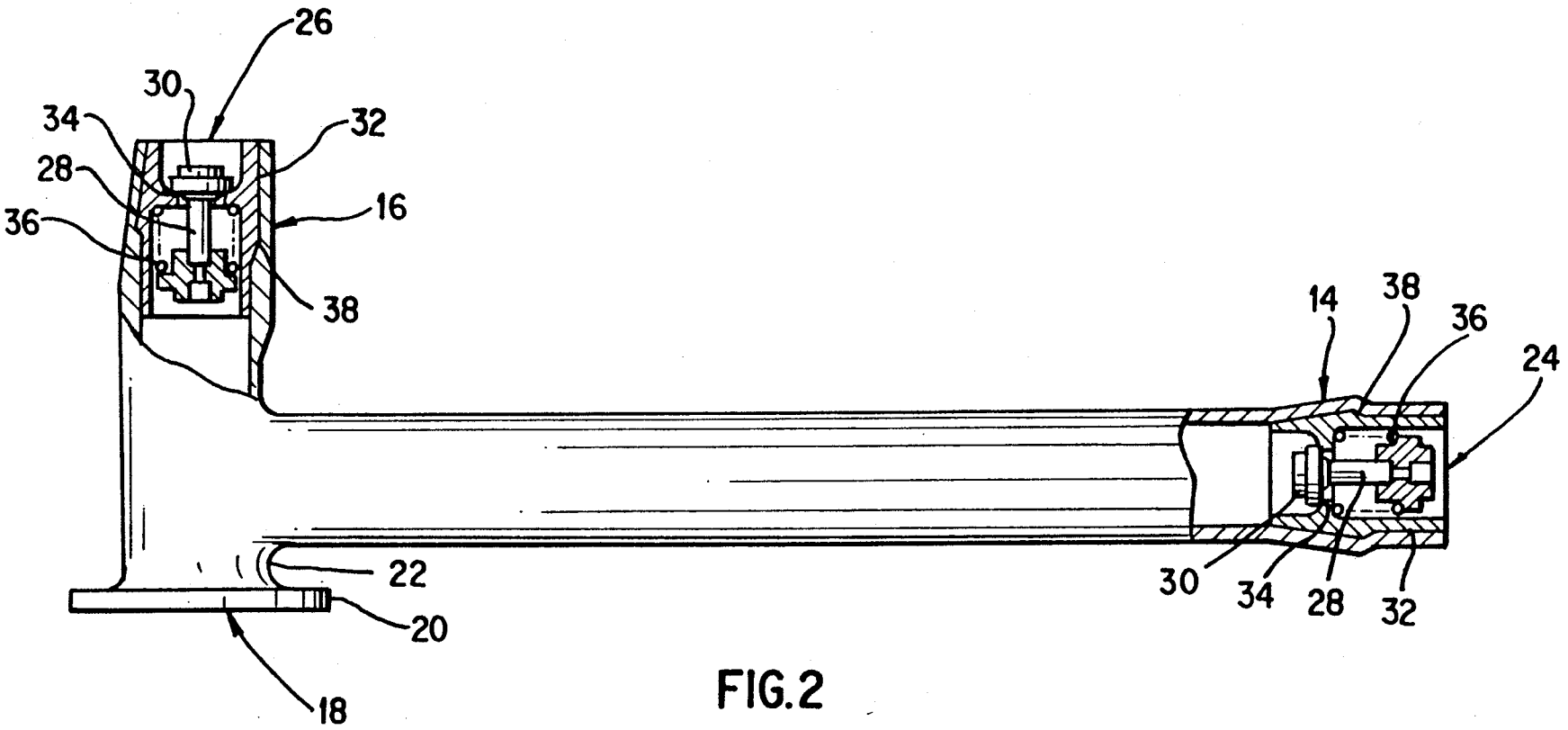
FIG. 2 is a side view, partially in section, of the L-shaped configuration of the oral inflation and relief tube of the invention.
Figure 3:
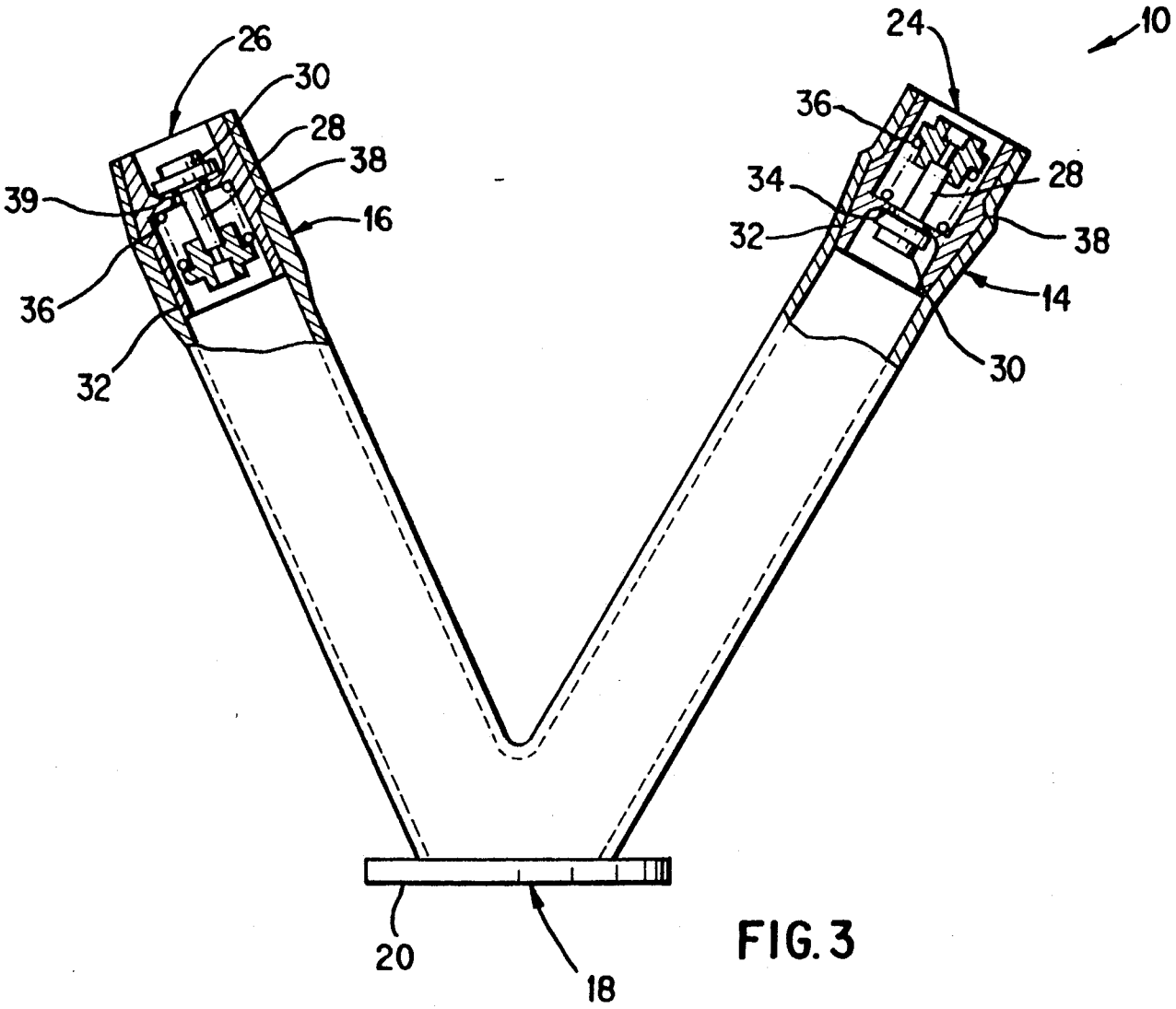
FIG. 3 is a side view, partially in section, of the V-configuration of the oral inflation and relief tube of the invention.
Figure 4:
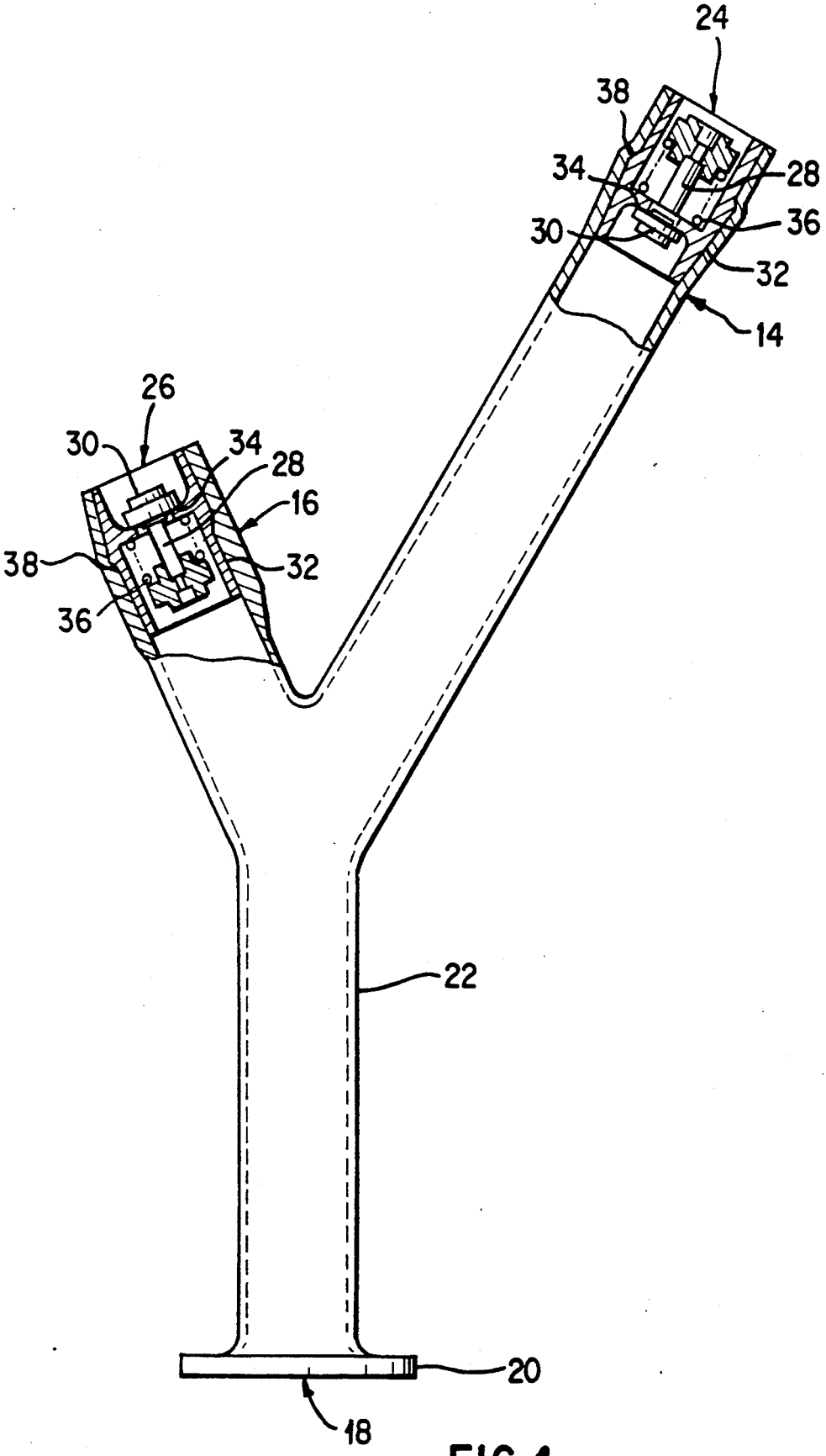
FIG. 4 is a side view, partially in section, of the Y-configuration of the oral inflation and relief tube of the invention.

As shown in FIGS. 1–4, the oral inflation and relief tube 10 of the invention comprises an elongated tube 12 having oppositely positioned first opened end 14 and second opened end 16, with a flanged opening 18 positioned therebetween. Preferably, flanged opening 18 comprises a mounting flange 20 and boss 22 which are integrally formed through the wall of the tube 12 to be in fluid communication with the interior of tube 12. As shown in FIG. 1, tube 12 may comprise an in-line configuration. Alternatively, as shown in FIGS. 2 and 3, tube 12 may comprise an arcuate configuration such as a L-configuration or a V-configuration. Further, in regard to the V-configuration embodiment of FIG. 3, it is noted that the boss 22 may include an elongated configuration as shown in FIG. 4 so as to transform the V-configuration into a Y-configuration. In each of the configurations, the flanged opening 18 is positioned between the first and second opened ends 14 and 16 of the tube 12.

It should be appreciated that the tube may be configured in any way that is most desirable when it is assembled to an inflatable article. It should also be understood that the flanged opening 18 may comprise other configurations designed to be sealingly connected to the wall of a bladder of an inflatable article.

In each of the embodiments of the oral inflation and relief tube 10 of the invention, an inflation valve 24 is pressed into the first opened end 14 and a relief valve 26 is pressed into the second opened end 16 of the tube 12 so as to seal with the lumen of the respective ends 14 and 16. The valves 24 and 26 may be functionally equivalent in the sense that an inflation valve opens to inflate the inflatable article and a relief valve opens to deflate the article.

More particularly, one type of such valves 24 and 26 comprises a valve stem 28 having a valve head 30 which is reciprocatably mounted within housing 32. A spring 36 is operatively connected to the valve stem 28 in such a manner to resiliently urge the valve head 30 in sealing engagement with a valve seat 34 of the housing 32. The force of spring 36 determines the cracking pressure necessary to move the valve head 30 away from the valve seat 34, thereby opening the valve 24 or 26 (see generally, U.S. Pat. Nos. 3,351,081, 4,176,681, 4,305,425 and 5,135,025, the disclosures of which are hereby incorporated by reference herein). Of course, spring 36 employed in the relief valve 26 should have an appreciably higher spring tension than the spring 36 of the inflation valve 24 so that the relief valve 26 does not open with the opening of the inflation valve 24 during inflation.

Irrespective of the specific type of inflation or relief valve 24 or 26 employed, most preferably the housing 32 of each such valve 24 and 26 comprises a generally circular cylindrical configuration of proper dimension to permit the valve 24 or 26 to be forced into the respective opened end 14 and 16 of the tube 12. However, the outside surface of the housing 32 of the valve 24 and 26 preferably includes one or more annular ridges 38 to more securely retain the valve 24 or 26 in their respective ends 14 or 16. Furthermore, as illustrated, the annular ridge 38 may comprise a sawtooth cross-sectional configuration facilitating insertion within the respective opened end 14 or 16, but precluding the valve 24 and 26 from being removed therefrom. Of course, since the inflation and relief valves 24 and 26 must be oppositely inserted into the respective opened ends 14 and 16 of the tube 12, the sawtooth configured annular ridges 38 must be oppositely formed during molding of the housing 32.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An oral inflation and relief tube for connection to an inflatable article, comprising in combination:

an elongated tube having an oppositely positioned first opened end and second opened end, with a flanged opening positioned therebetween at ninety degrees for connection to the inflatable article;

said flanged opening comprising a mounting flange and boss integrally formed through a wall of said elongated tube;

an inflation valve sealingly positioned within said first opened end;

a relief valve sealingly positioned within said second opened end; and said elongated tube comprising an in-line configuration, said inflation valve and said relief valve and said tube comprising a generally-cylindrical configuration with a common axis, with said boss positioned substantially adjacent to said second opened end away from said first opened end such that when said mounting flange of said flanged opening is connected to the inflatable article, said in-line configuration of said elongated tube lies substantially parallel to the inflatable article while permitting said first and opened end to be grasped and rotated about said boss and orally inflated, said inflation valve and said relief valve each having a coil spring with the coil spring of said relief valve having a higher cracking pressure than said inflation valve.

* * * * *